US006276907B1

(12) United States Patent
Cooper et al.

(10) Patent No.: US 6,276,907 B1
(45) Date of Patent: Aug. 21, 2001

(54) HYDRAULICALLY DRIVEN DIAPHRAGM PUMP

(75) Inventors: Robert D. Cooper, Elk River; Thomas F. Kruzel, Maple Grove; Shawn C. Johnson, Clear Lake; Wayne M. Bekius, Milaca, all of MN (US)

(73) Assignee: Wagner Spray Tech Corporation, Minneapolis, MN (US)

( * ) Notice: Subject to any disclaimer, the term of this patent is extended or adjusted under 35 U.S.C. 154(b) by 0 days.

(21) Appl. No.: 09/372,902

(22) Filed: Aug. 12, 1999

(51) Int. Cl.[7] ..... F04B 43/06; F04B 9/08; F04B 19/00

(52) U.S. Cl. ..... 417/395; 417/386; 417/385; 417/388; 92/98 R; 92/96

(58) Field of Search ..... 417/386, 385, 417/388, 395; 92/96, 98 R, 100, 99

(56) References Cited

U.S. PATENT DOCUMENTS

| | | | | |
|---|---|---|---|---|
| 2,856,857 | * | 10/1958 | Saalfrank | 103/44 |
| 3,312,171 | * | 4/1967 | Cary | 103/44 |
| 3,416,461 | * | 12/1968 | McFarland | 103/150 |
| 3,680,981 | * | 8/1972 | Wagner | 417/388 |
| 3,925,988 | | 12/1975 | Kelley | 60/539 |
| 4,785,719 | | 11/1988 | Bachschmid et al . | 92/95 |
| 4,828,464 | * | 5/1989 | Maier et al. | 417/388 |
| 4,864,918 | * | 9/1989 | Martin | 92/103 |
| 4,934,906 | | 6/1990 | Williams | 417/388 |
| 5,073,092 | | 12/1991 | Gebauer et al. | 417/383 |
| 5,084,964 | | 2/1992 | Cyphers | 29/888.02 |
| 5,145,331 | | 9/1992 | Goes et al. | 417/383 |
| 5,192,198 | * | 3/1993 | Gebauer et al. | 417/383 |
| 5,246,351 | * | 9/1993 | Horn et al. | 417/387 |
| 5,306,122 | | 4/1994 | Gebauer et al. | 417/383 |
| 5,520,523 | * | 5/1996 | Yorita et al. | 417/387 |
| 5,624,246 | | 4/1997 | Kuhlenschmidt | 417/386 |
| 5,863,184 | | 1/1999 | Juterbock et al. | 417/383 |

FOREIGN PATENT DOCUMENTS

| | | |
|---|---|---|
| 1800018 | 8/1969 | (DE) . |
| 30 27 314 A1 | 11/1982 | (DE) . |
| 30 18 687 C2 | 10/1986 | (DE) . |
| 0 188 730 A2 | 12/1985 | (EP) . |
| 0 809 028 A2 | 11/1997 | (EP) . |

* cited by examiner

*Primary Examiner*—Timothy S. Thorpe
*Assistant Examiner*—Timothy P. Solak
(74) *Attorney, Agent, or Firm*—Faegre & Benson, LLP

(57) ABSTRACT

A diaphragm pump for pumping a fluid, such as paint, includes a diaphragm separating a first chamber for accommodating and dispensing the paint from a second chamber for accommodating a drive fluid, and a piston that reciprocates to drive the drive fluid within the second chamber in order to flex the diaphragm to provide the pumping action within the first chamber. The diaphragm pump also includes a backing ring mounted adjacent the diaphragm that is configured to distribute the drive fluid across the diaphragm to cause a flexible region of the diaphragm to flex toward the first chamber from the outer perimeter inward toward a central pumping surface in a rolling manner. This diaphragm movement results in substantially all of the paint adjacent the diaphragm within the first chamber to move out of the first chamber when the diaphragm reaches its travel limit, and thus improves the efficiency of the diaphragm pump. Additionally, the diaphragm pump includes a drive fluid inlet formed within the piston, such that reciprocating movement of the piston results in an inflow of drive fluid into the second chamber. An input port in the piston is continuously submerged in the drive fluid when open, thereby substantially eliminating the introduction of air into the drive fluid system and thus reducing drive fluid priming problems.

14 Claims, 16 Drawing Sheets

HYDRAULICALLY DRIVEN DIAPHRAGM PUMP

FIELD OF THE INVENTION

This invention relates to diaphragm pumps with increased efficiency due to improvements in the diaphragm and drive fluid systems. Such diaphragm pumps typically have an oil section driving a load fluid section, to pump paint for example.

BACKGROUND OF THE INVENTION

Diaphragm pumps for pumping paint and other fluids have been available for years for both industrial and commercial applications. Although these pumps have been meeting consumer and professional requirements, changes in the market and economy, including increased market competition and decreased profit margins, have increased the need for more cost effective production, cost reductions and improved pump efficiencies. In addition, the expansion of the consumer market has increased the need for varying pump configurations at a range of price levels.

A drawback of the current pump that becomes evident when the pump is used in varying configurations, is a loss of prime. Pooling of hydraulic fluid away from the fluid inlet of the pump can occur in different pump orientations, especially when the fluid inlet is located at an outer limit position within the pump. In these orientations, the hydraulic fluid portion of the pump takes in air or possibly runs dry causing numerous mechanical problems that usually must be repaired by a service representative, thereby causing time delays, extra costs and loss of productivity.

In view of the deficiencies of currently available pumps and the ever changing needs of consumers, a need exists for a diaphragm pump that doesn't lose prime no matter what its orientation and has improved efficiency without increasing manufacturing costs.

SUMMARY OF THE INVENTION

A diaphragm pump with improved efficiency and substantial elimination of priming problems at all orientations of the pump is provided in the present invention. The diaphragm pump includes a first chamber for accommodating and dispensing a fluid to be pumped, such as paint, and a second chamber for accommodating a drive fluid. A diaphragm separates the first chamber from the second chamber and has a first chamber side and a second chamber side. The diaphragm includes an outer perimeter mounting region, a thin inner perimeter flexible region, and a contoured central drive region having a stem on the second chamber side and a central pumping surface on the first chamber side. The diaphragm is movable from a first limit farthest away from the first chamber to a second limit closest to the first chamber. A motor mounted eccentric causes reciprocating movement of a piston located at least partially within the second chamber. The piston movement results in corresponding drive fluid movement within the second chamber, flexing the diaphragm to provide a pumping action within the first chamber for dispensing the fluid to be pumped.

The diaphragm pump also includes a drive fluid inlet for supplying drive fluid to the second chamber. The drive fluid inlet has a drive fluid supply passage formed axially within the piston having a first end and a second end, the first end of the supply passage open to the second chamber, and an input port formed within the piston transverse to the supply passage. One end of the input port intersects the supply passage near the second end of the supply passage, and the other end of the input port is at least partially open to a drive fluid supply at a predetermined position of the piston within the second chamber. As the piston reciprocates, the input port is closed to the drive fluid in the drive fluid supply during a portion of the reciprocating movement of the piston and the input port is open to the drive fluid in the drive fluid supply at another portion of the reciprocating movement of the piston. This results in an inflow of drive fluid through the input port into the supply passage and second chamber. When the input port is open it is continuously submerged in the drive fluid at all orientations of the pump, thereby substantially eliminating the introduction of air into the drive fluid system, and thus reducing priming problems in the drive fluid section.

The diaphragm pump of the present invention also includes a backing ring mounted within the second chamber adjacent to the diaphragm defining a central opening through which the stem of central drive region of the diaphragm passes. The backing ring has a plurality of holes configured to distribute the drive fluid across the diaphragm after the drive fluid is driven by the drive fluid movement within the second chamber through the plurality of holes. It also has a diaphragm mating surface contoured to mate with the second chamber side of the diaphragm As the drive fluid passes through the plurality of holes into a drive fluid volume defined between the diaphragm mating surface of the backing ring and the second chamber side of the diaphragm, it forces the diaphragm membrane from the first limit toward the first chamber while flexing the flexible region of the diaphragm toward the first chamber from the outer perimeter inward toward the central pumping surface in a rolling manner. Through this action, the diaphragm moves substantially all of the fluid to be pumped adjacent the diaphragm within the first chamber inward toward the central pumping surface and then out of the first chamber when the diaphragm reaches the second limit. Therefore, the efficiency of the diaphragm pump increases as more fluid is pumped with every stroke of the piston.

DETAILED DESCRIPTION OF THE INVENTION

Figure 1:
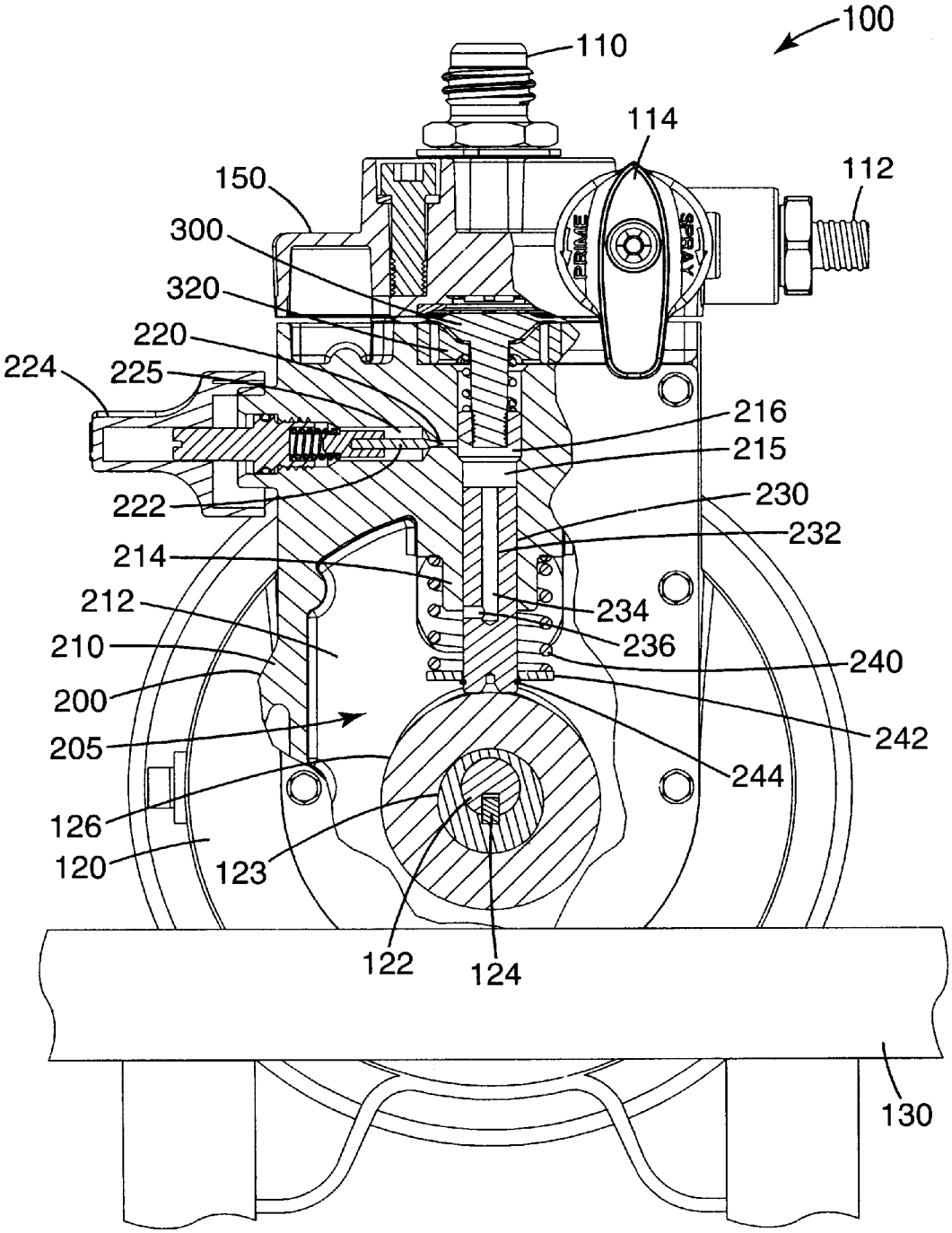
FIG. 1 is an end elevation view of a diaphragm pump in accordance with the present invention with a cut-away view of the interior portion of the pump.

With reference to the attached Figures, it is to be understood that like components are labeled with like numerals throughout the several Figures. FIG. 1 is a diaphragm pump 100 for pumping a fluid, such as paint, stain or other suitable fluid, hereinafter referred to as "paint," which preferably works together with a paint spray gun (not shown) connected to the pump 100 by a hose (also not shown) to paint a surface. The pump 100 includes a first chamber 150 for accommodating the paint to be pumped, a second chamber 200 for holding a drive fluid 205, a motor 120 for powering the pump 100, and a frame 130 for supporting the pump 100 and motor 120. A diaphragm 300 separates the first chamber 150 from the second chamber 200 and conveys pumping action from the drive fluid 205 to the paint.

Figure 2:
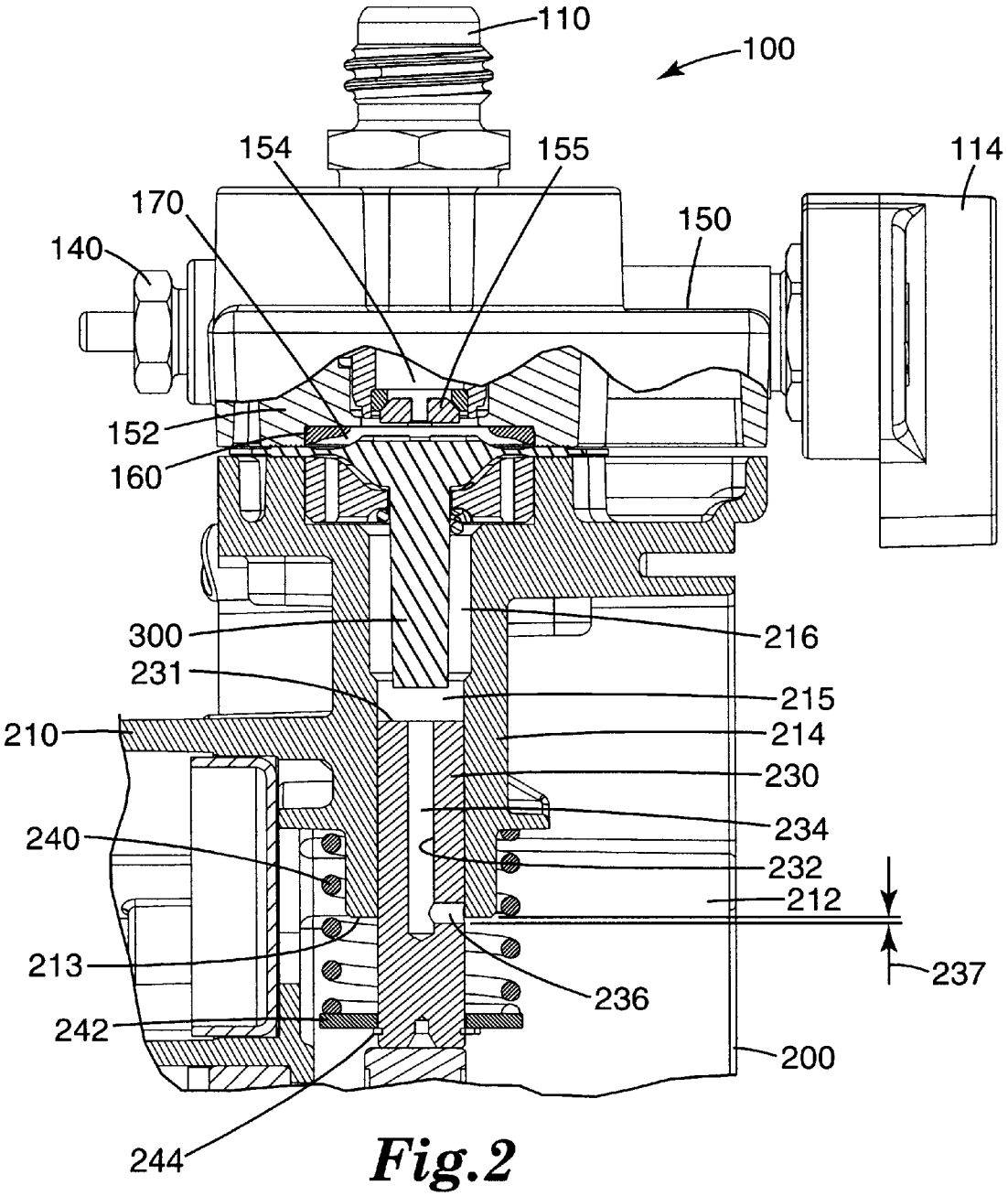
FIG. 2 is a side elevation view with a cut-away portion of the pump in FIG. 1 showing a close-up detail view of the piston and drive fluid inlet in bottom dead center position.
Figure 3:
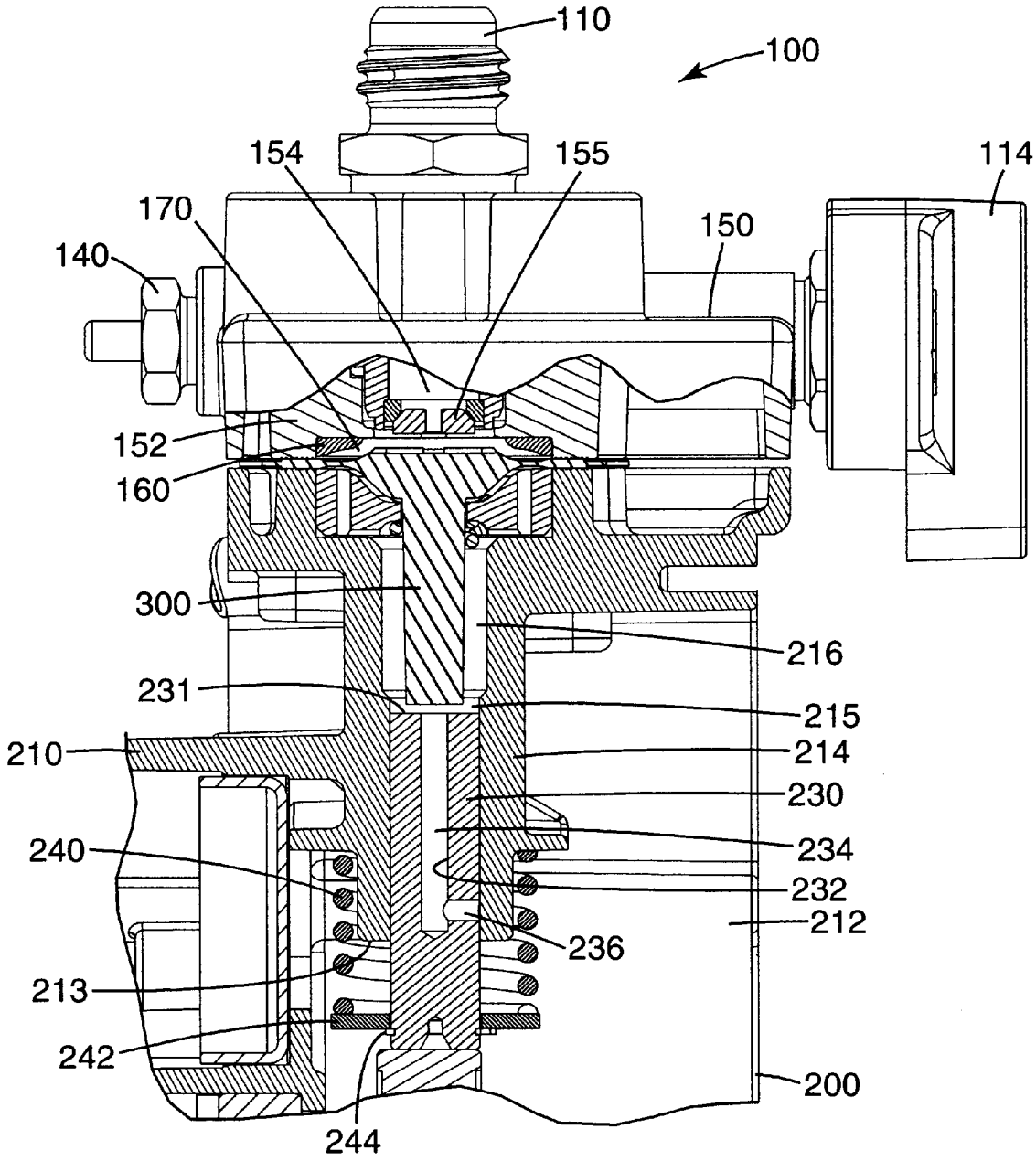
FIG. 3 is a side elevation view with a cut-away portion of the pump similar to FIG. 2 except showing a close-up detail view of the piston and drive fluid inlet in top dead center position.
Figure 4:
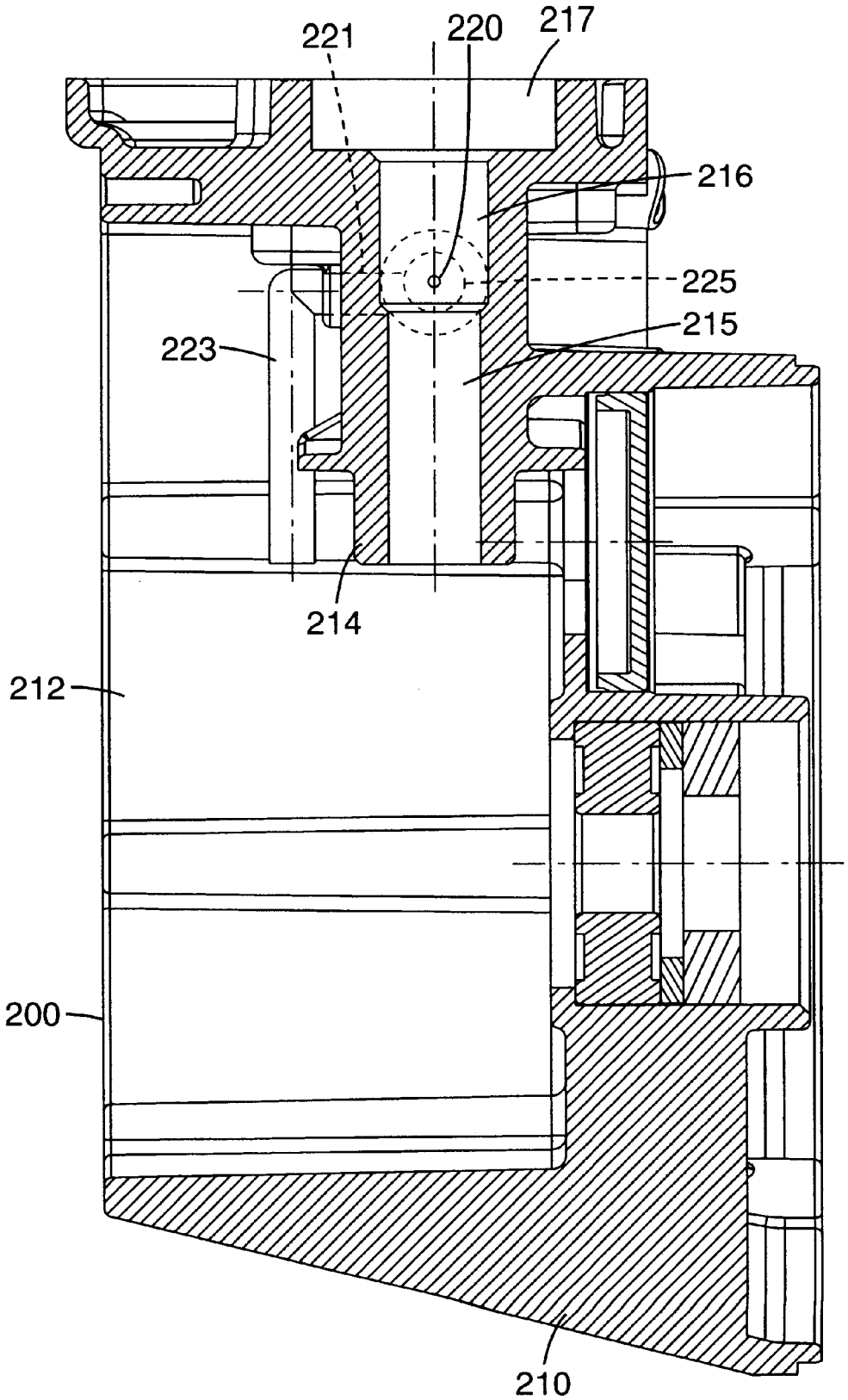
FIG. 4 is a cross-sectional side view of a hydraulic housing portion of the pump useful in the practice of the present invention.

Referring now also to FIGS. 2–4, the second chamber 200 includes a housing 210 within which a reservoir 212 for holding the drive fluid 205, a cylinder 214, and a drive fluid outlet 220 are formed. As shown best in FIG. 4, the cylinder 214 includes three bore portions: a piston portion 215, a diaphragm portion 216 and a backing ring bore 217. Referring now to FIGS. 1–3, the piston portion 215 houses a piston 230 and the diaphragm portion 216 houses part of the diaphragm 300. As the motor 120 rotates a shaft 122, an eccentric 123 attached to the shaft 122 at key 124 revolves within a bearing 126, causing the piston 230 to reciprocate within the cylinder 214. A piston spring 240, interposed between the housing 210 and a spring retainer 242 coupled to the piston 230 by a retainer ring 244, provides a spring force to aid in the return stroke of the piston 230.

Reciprocation of the piston 230 within cylinder 214 results in the drive fluid 205 passing into the piston portion 215 and then diaphragm portion 216 of the cylinder 214. Within the diaphragm portion 216, the drive fluid 205 contacts the diaphragm 300 causing a reciprocating movement of the diaphragm 300 corresponding to the reciprocating movement of the piston 230.

The first chamber 150 of the pump 100 includes a housing 152 that attaches to the second chamber housing 210, sealed by the diaphragm 300. Paint enters the first chamber housing 152 at a paint inlet 110 that contains a check valve 155. The paint inlet 10 may be threaded to facilitate connection to a supply hose or pipe (not shown) connecting the pump to a supply of paint. The paint passes through a paint passage 154 to encounter a pumping surface 314 located on the paint side of the diaphragm 300. The reciprocating movement of the diaphragm 300 then causes the paint to flow out of the first chamber 150 under pressure through paint outlet 112 that also contains a check valve (not shown), and then through a hose to a paint spray gun (as described above).

Referring now most particularly to FIG. 1, pressure regulation of the paint output occurs through adjustment of the drive fluid outlet 220. The drive fluid outlet 220 is fluidly connected to the diaphragm portion 216 of the cylinder 214 and is fluidly coupled to a passage 225. As shown in FIG. 4, a drive fluid return 221 (shown in dashed lines) fluidly connects passage 225 (also shown in dashed line) to a drive fluid return tube 223 that returns the drive fluid 205 to the reservoir 212. Referring again to FIG. 1, a needle valve 222 located within both drive fluid passage 225 and drive fluid outlet 220 regulates the flow of drive fluid 205 from the cylinder 214 back to the reservoir 212. Adjustment of the pressure of the drive fluid 205 within the cylinder 214, by adjustment of needle valve 222 through rotation of an external pressure control knob 224, allows a user to regulate the output pressure of the paint being pumped.

As shown in FIGS. 1–3, also included on the pump 100 are an external knob 114 for switching between "spray" and "prime" modes of the pump 100, and a pusher valve 140. The spray knob 114 switches an internal valve (not shown) directing paint to be returned to the paint source (for priming operation) and selectively to the outlet 112 (for painting, once the paint section is primed). The pusher valve 140 provides a backup feature for the outlet valve in paint outlet 112 by pushing the ball portion of the outlet valve in the event of the ball becoming stuck.

Figure 5:
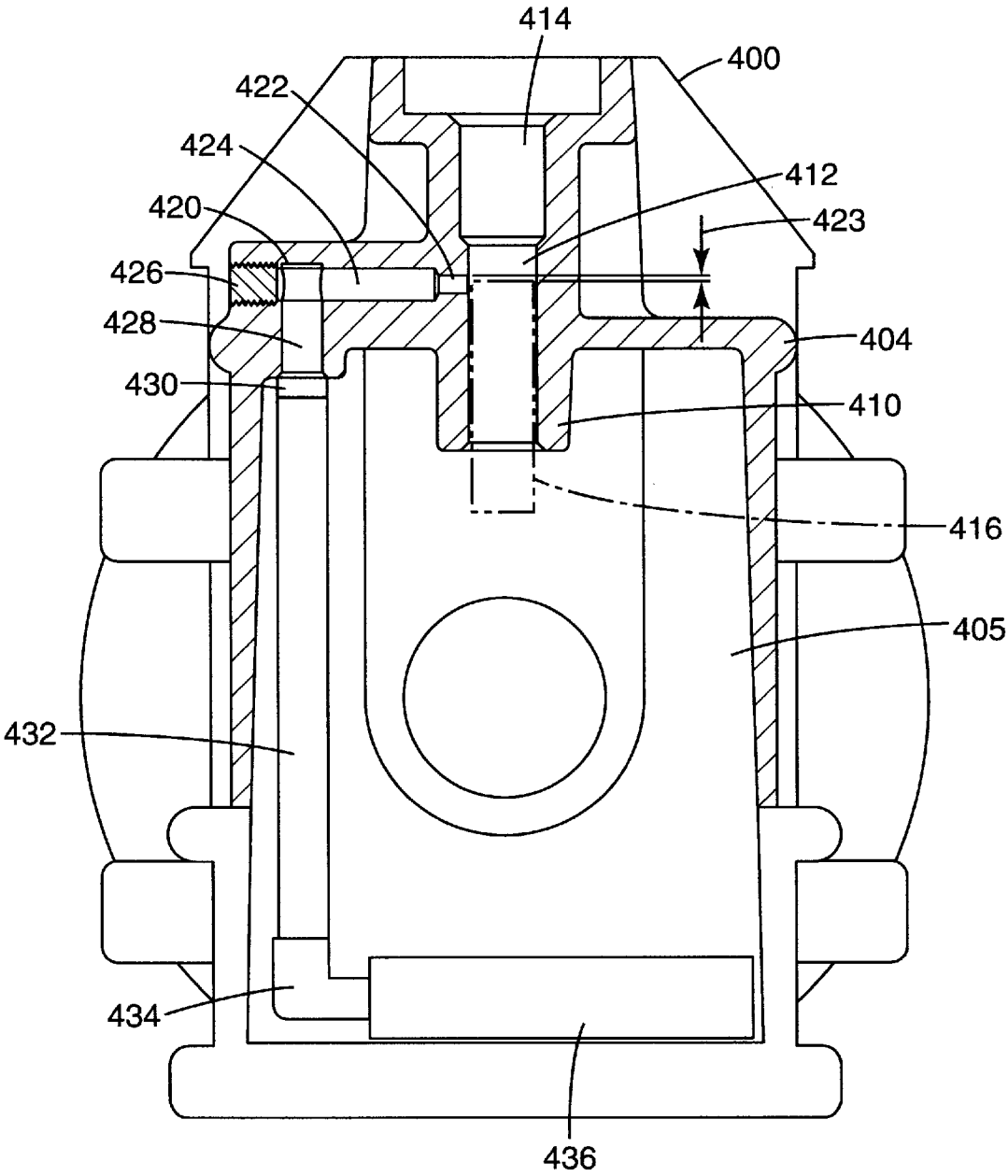
Fig. 5 PRIOR ART
FIG. 5 is a partial cross-sectional end view of the hydraulic housing of FIG. 4.

Referring now to FIGS. 2, 3 and 5, as described above, flow of the drive fluid 205 into the cylinder 214 provides the driving force for the diaphragm 300 and, thus the paint out of the pump 100, and therefore is important to the overall function, performance and efficiency of the pump 100. In FIG. 5, a portion of a prior art pump 400 having a housing 404 and a reservoir 405 is shown. Formed within the housing 404 is a cylinder 410, similar to that shown in FIGS. 2 and 3, that has a piston portion bore 412 and a diaphragm portion bore 414, in which a piston 416 (shown in phantom) reciprocates, as described above. In pump 400, drive fluid flow into the cylinder 410 occurs through a drive fluid inlet 420 that intersects the piston portion bore 412 near the transition to the diaphragm portion bore 414 of the cylinder 410.

The drive fluid inlet 420 includes an inlet opening 422 in fluid connection with the piston portion bore 412, an inlet passage 424 drilled through the housing 404 from the exterior to the inlet opening 422, preferably perpendicular to the cylinder 410, and an intersecting passage 428 formed parallel to the cylinder 410 fluidly connecting the reservoir 405 to the inlet passage 424. The exterior portion of the inlet passage 424 beyond the intersecting passage 428 is sealed by a plug 426, creating a single fluid pathway from the reservoir 405 to the piston portion bore 412. Drive fluid enters this pathway through a bubble filter 436 connected at elbow 434 to tube 432, which is fluidly coupled to intersecting passage 428 by way of a tube coupler 430.

As the piston 416 reciprocates it repeatedly opens and closes the inlet opening 422, thereby drawing drive fluid into the piston portion 412 from the drive fluid inlet 420. Although functional, this type of drive fluid system requires multiple parts and multiple machining steps, thus increasing the overall cost of the pump 400. In addition, although the filter 436 is usually immersed within the drive fluid located in the reservoir 405, changing the pump 400 orientation may cause the filter 436 to take in air instead of only drive fluid. This situation may cause a loss of prime in the drive fluid portion of the pump 400, resulting in pump failure and/or damage.

The present invention overcomes the drive fluid system shortcomings of the prior art pump 400 by innovatively relocating the drive fluid inlet 232 to the piston 230 itself. In FIGS. 2 and 3, the pump 100 of the present invention is shown wherein the piston 230 includes a drive fluid input port 236 in fluid connection between the reservoir 212 and a supply passage 234. The supply passage 234 is preferably formed along a longitudinal axis of the piston 230 between the input port 236 and a piston end 231 on the diaphragm side of the piston 230, thus creating a fluid pathway between the reservoir 212 and the piston portion 215. As positioned, the input port 236 remains continuously submerged within the drive fluid 205 of the reservoir 212 at any orientation of the pump 100. Therefore, air entrapment in the drive fluid pathway is avoided, thus reducing drive fluid priming problems and repairs with the pump 100.

In FIG. 2, the piston 230 is shown in its most extended position, hereinafter the bottom-dead-center position. It is to be understood, however, that direction of travel of the piston 230 relative to the ground is not implied by this designation, since the pump 100 may be positioned in various orientations and thus the piston 230 may travel in various directions relative to the ground. At bottom-dead-center, the input port 236 preferably extends partially beyond the cylinder 214 at cylinder limit 213, providing a circular segment shaped opening having an opening height 237. The input port 236 is preferably about 0.1195±0.0015 inches in diameter, and the opening height 237 is preferably about 0.035±0.010 inches, and more preferably within about ±0.005 inches.

As shown in FIG. 3, as the piston 230 reciprocates it reaches its most retracted position, hereinafter the top-dead-center position. It is to be understood, however, that, as discussed above, no direction of travel relative to the ground is to be implied from this designation. At top-dead-center, the input port 236 is completely closed off from the reservoir 212 by the cylinder 214. With this configuration, the input port 236 cooperates with the cylinder 230 to serve as a valve, thereby controlling the flow of drive fluid 205 from the reservoir 212 into the cylinder 230.

Figure 6:
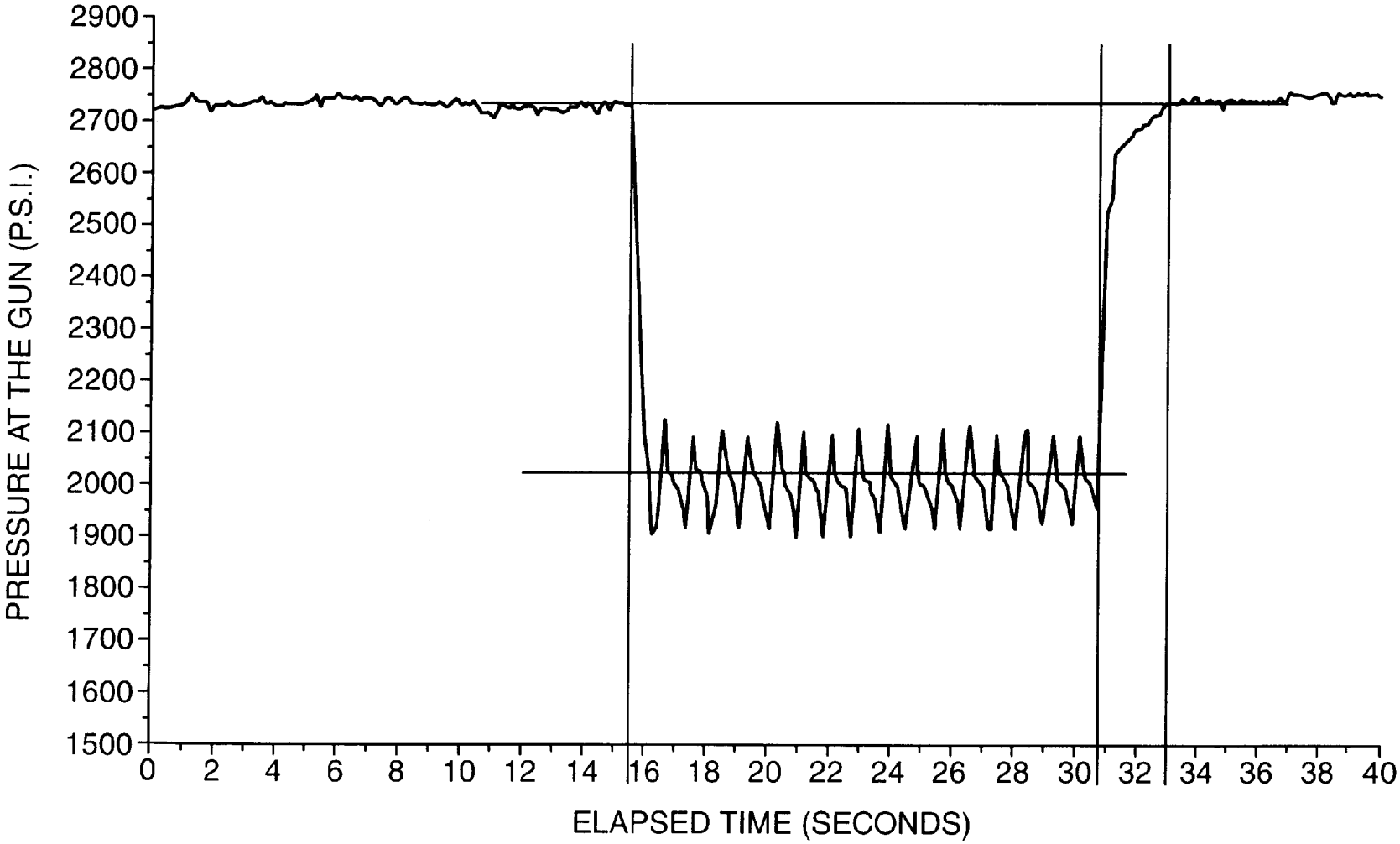
FIG. 6 is an oscillograph recording showing pressure at a paint spray gun verses time for a diaphragm pump having a drive fluid inlet opening height of 0.035 inch.

The opening height 237 at bottom-dead-center, in combination with the diameter of the input port 236, provide a timing function reflected in the time the pump 100 takes to reach a working pressure at the paint spray gun once the gun is opened. In FIG. 6, an oscillograph record shows the pressure at the gun verses time for an opening height 237 of 0.035 inches. Prior to the gun being opened, the stall pressure at the gun is about 2740 p.s.i. At about 15 seconds, the gun is opened and the pressure drops down to about an average of 2030 p.s.i. in about 1 second. When the gun is again closed, at about 30.8 seconds, the pressure returns to its stall value in about 1.2 seconds. These test results demonstrate an almost flat, extremely quick recovery time of the pump at this opening height 237, making it an optimum opening height value.

Figure 7A:
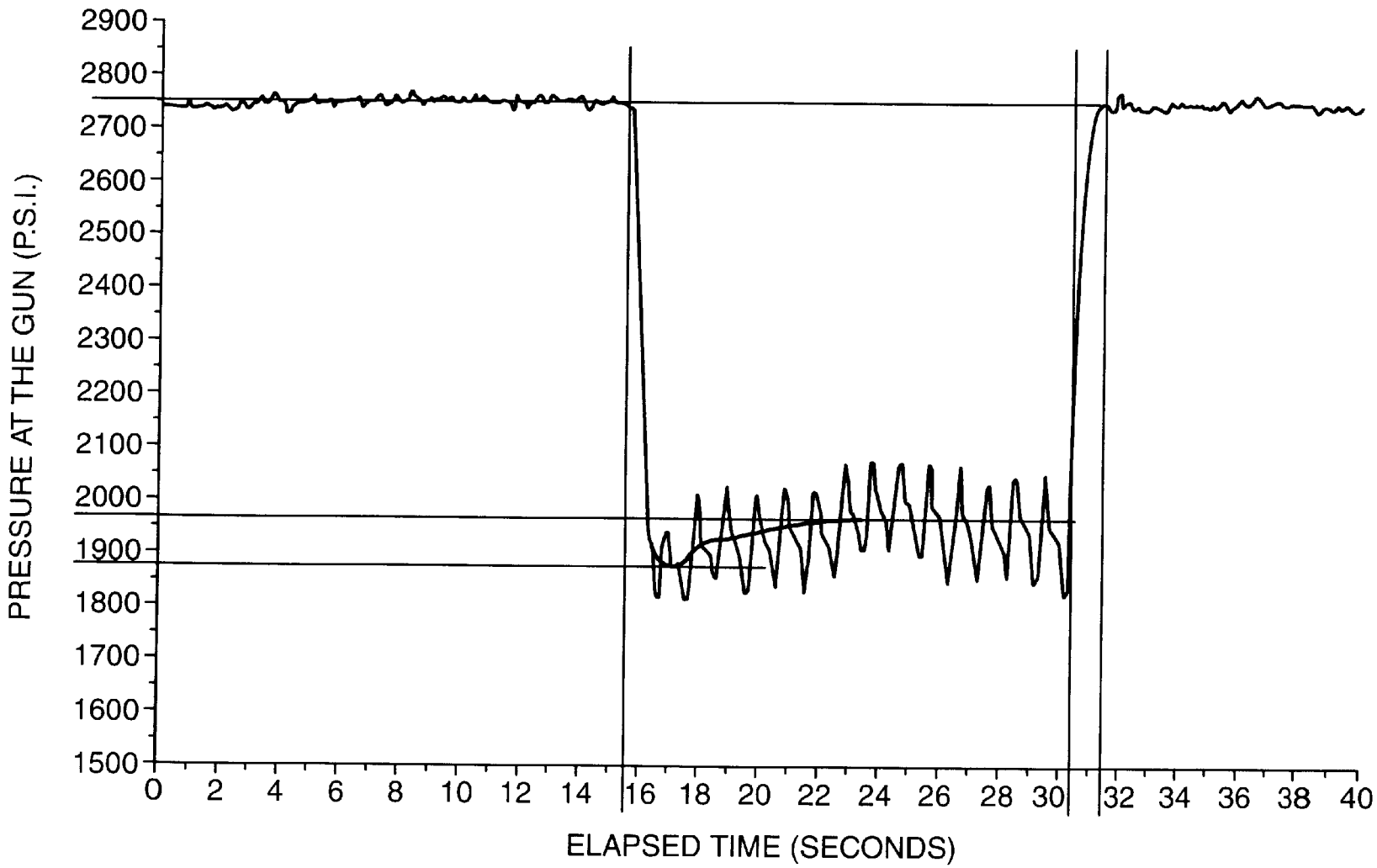
FIG. 7A is an oscillograph recording showing pressure at a paint spray gun verses time for a diaphragm pump having a drive fluid inlet opening height of 0.025 inch.
Figure 7B:
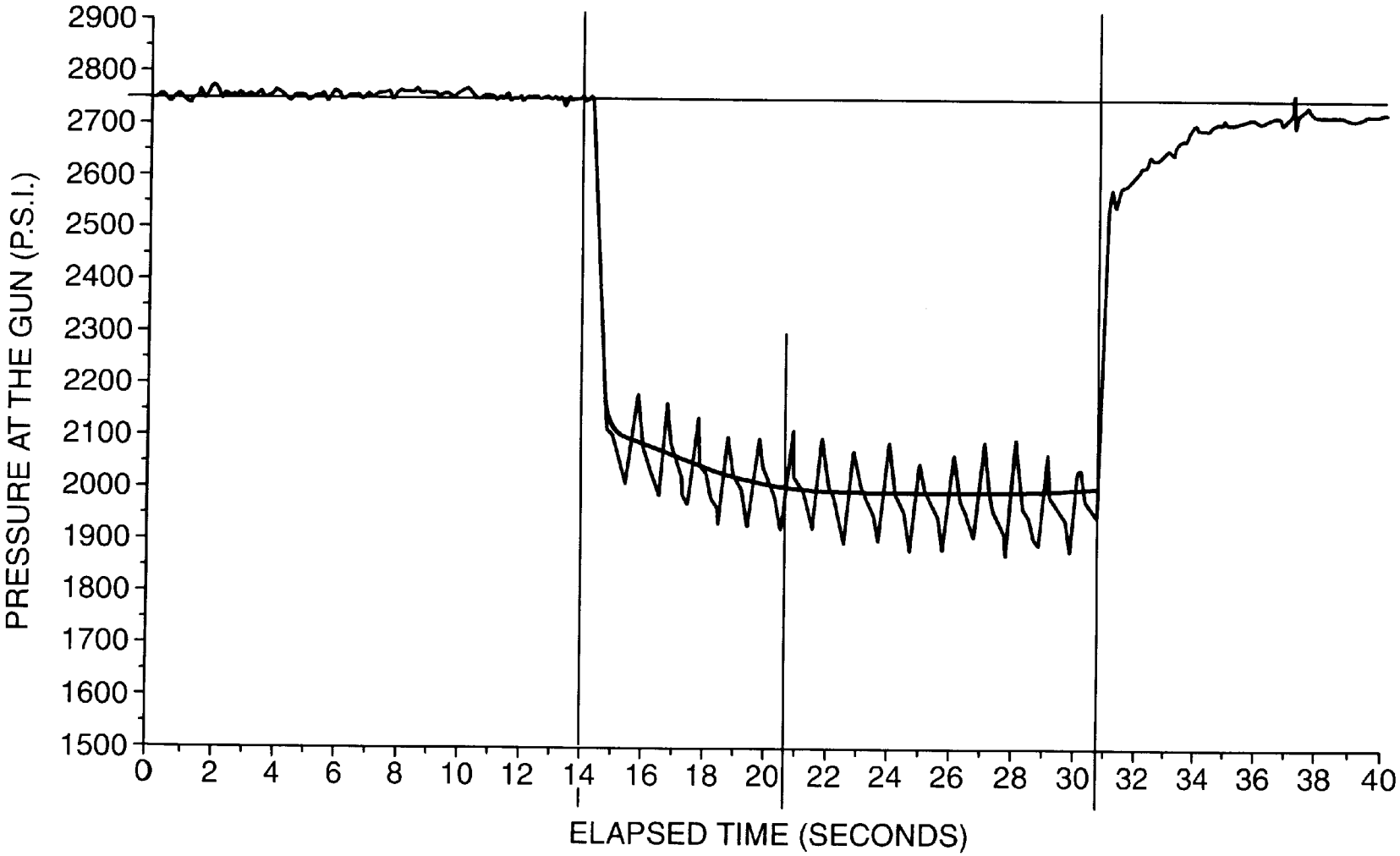
FIG. 7B is an oscillograph recording showing pressure at a paint spray gun verses time for a diaphragm pump having a drive fluid inlet opening height of 0.045 inch.

By comparison, FIG. 7A shows the pressure verses time results of a 0.025 inch opening height, wherein the recovery time is upwards of about 6.5 seconds to reach the working pressure at the gun. FIG. 7B shows the pressure verses time results of a 0.045 inch opening, wherein recovery time is also upwards of about 6.5 seconds. The recovery times (not shown) for both a 0.015 and a 0.065 inch opening heights are both in the range of about 10–11 seconds. As is apparent from this data, as the opening height 237 varies from an optimum value of 0.035 inches, the recovery times becoming larger, making the pump performance less efficient.

Figure 8:
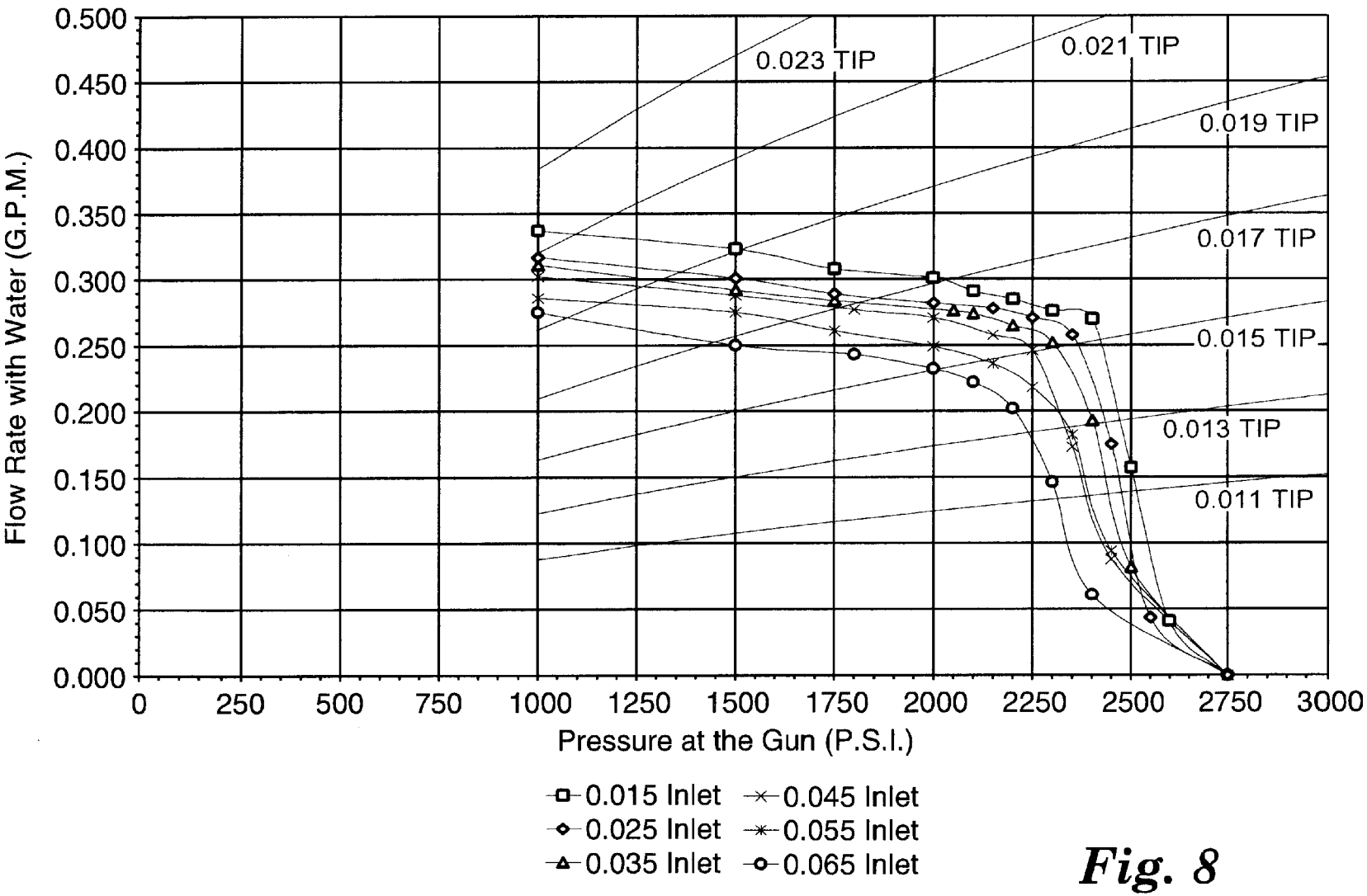
FIG. 8 is a plot showing a family of curves of flow rate of the pumped fluid versus pressure, at the spray gun, for a pump having different size drive fluid openings as a parameter.

In addition, as shown in FIG. 8, the opening height 237 of about 0.035 inches provides a good flow rate, in the range of about 0.27 to 0.28 gallons per minute, at a working gun pressure range of 2000 to 2500 p.s.i., which is the preferred range for latex paint to shear and atomize at the tip of the paint spray gun. The other opening height values, also shown in FIG. 8, provide varying flow rates at this working pressure range. The flow rates of the larger opening height values drop off significantly in this pressure range indicating their inefficiency and, thus, unsuitability for use in this pressure range. In contrast, the smaller openings demonstrate higher flow rates and, thus, better performance in this pressure range. However, when viewed in combination with the recovery time results of these smaller openings, it can be seen that they are less suitable than the preferable opening of 0.035 inches because the end user will cause repetitive opening and closing of the spray gun as the user coats a surface with the paint and, thus, will be more aware of the smaller opening's deficiencies in recovery time than of the possible higher performance at a full-open condition.

The ability of the pump 100 of the present invention to function at the above described preferred parameters is facilitated by an improved ability to machine the input port 236 with precision. The piston 230 is preferably formed from stainless steel, allowing precise machining of the drive fluid inlet 232. In FIG. 5, the prior art inlet opening 422 has the same general diameter as the input port 236, however the resulting opening height 423 can vary from about 0.020 to 0.060 inches. This variation is due to tolerance build-up in machining of the inlet opening 422 through the housing 404. In contrast, the input port 236 of the present invention may be precisely drilled in the piston 230, and thus is not susceptible to tolerance build-up errors of the same magnitude. Therefore, the overall performance of the pump 100 is an improvement over that of the prior art pump 400. In addition, the amount of machining necessary is reduced in the present invention pump 100, requiring two precision holes 234, 236 drilled within the piston 230 verses the three bores of the prior art 422, 424, 428, plus sealing of the exterior portion of the drive fluid inlet with plug 426.

Another improvement of the present invention over the prior art is the reduction in parts needed to perform the drive fluid input function. As shown in FIG. 5, the tube coupler 430, tube 432, elbow coupler 434 and bubble filter 436 are all required as part of the drive fluid inlet system. In contrast, the present invention requires no additional parts, but instead makes use of the already provided piston 230 to perform the same function.

Figure 9:
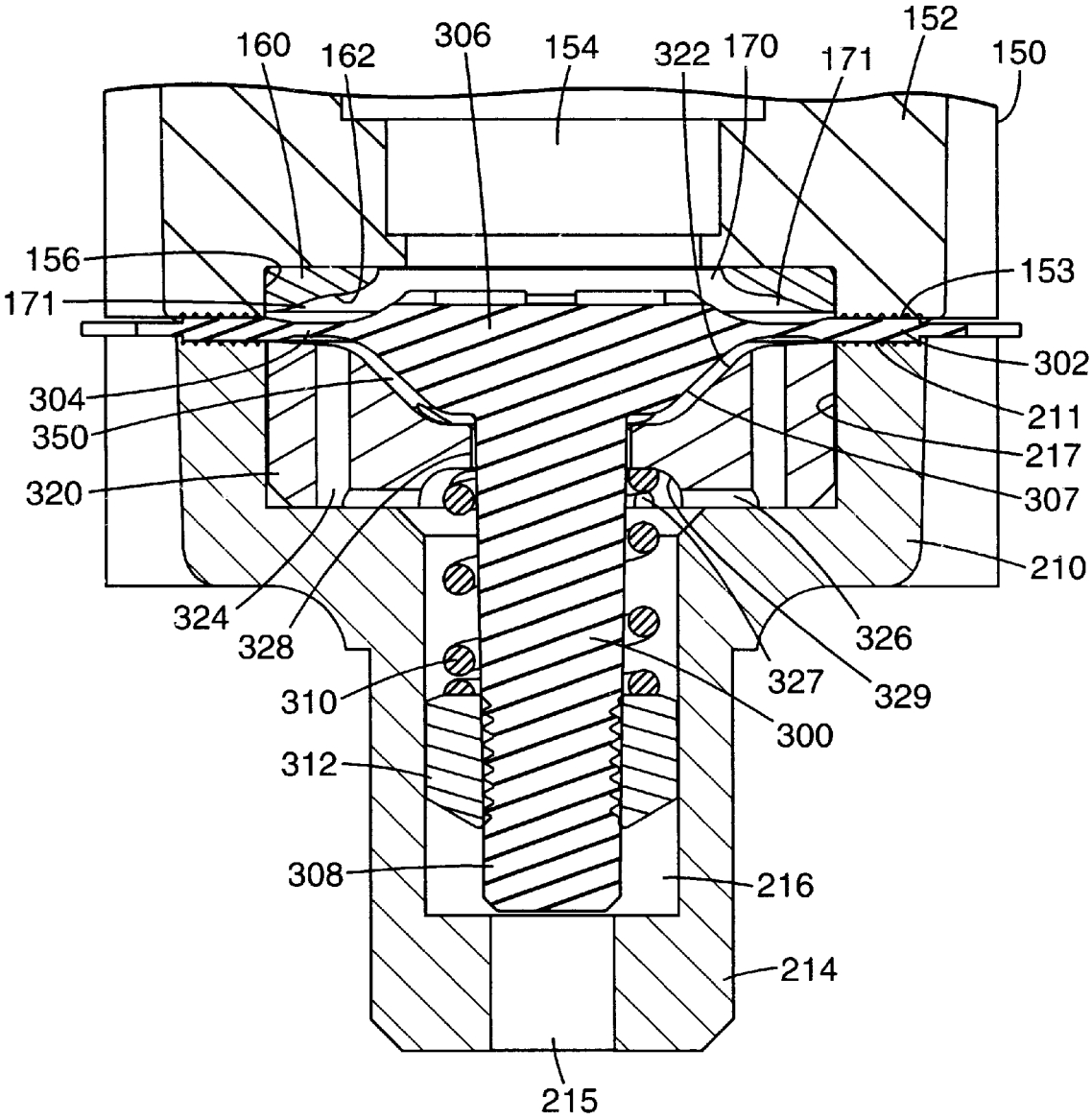
FIG. 9 is an enlarged side elevation cross-sectional view of the diaphragm portion of the pump in FIG. 1.

Referring now to FIGS. 2 and 9, as described above, once the drive fluid 205 enters the piston portion 215 it acts on the diaphragm 300 in response to the reciprocating action of the piston 230. As shown in FIG. 9, the diaphragm 300 includes a central drive region 306 having a stem 308 that extends into the diaphragm portion 216 of the cylinder 214. This central region 306 thins into a membrane toward an outer perimeter forming a flexible region 304 that extends further outward to form a mounting region 302 around the outer perimeter of the diaphragm 300. The mounting region 302 is sandwiched between the first chamber housing 152 and the second chamber housing 210 to seal the drive fluid side from the paint pumping side of the pump 100, and to hold the diaphragm 300 in position. To facilitate an adequate seal between the two chambers 150, 200, both the first chamber housing 152 and the second chamber housing 210 include a series of knurled rings 153, 211, respectively, formed within the housings 152, 210 to grip the mounting region 302 of the diaphragm 300. Also preferably included, but not shown, are a number of mounting holes, formed as four symmetrically placed tabs around the outer perimeter of the mounting region 302 having through holes through which four mounting screws (not shown) pass when the first chamber 150 is coupled to the second chamber 200.

Figure 11:
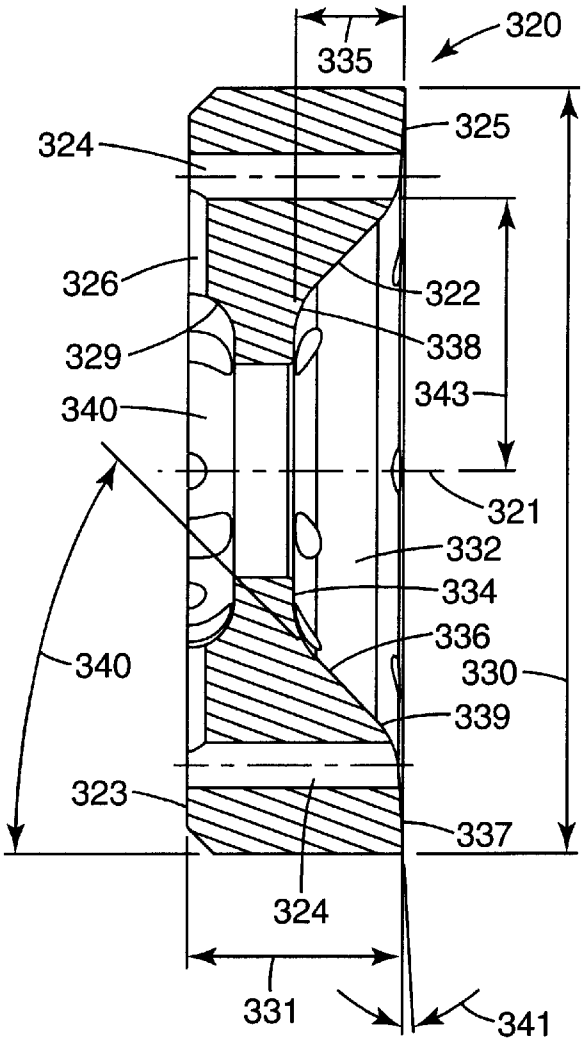
FIG. 11 is a cross-sectional view of the backing ring of FIG. 10 taken along Line A—A.
Figure 10:
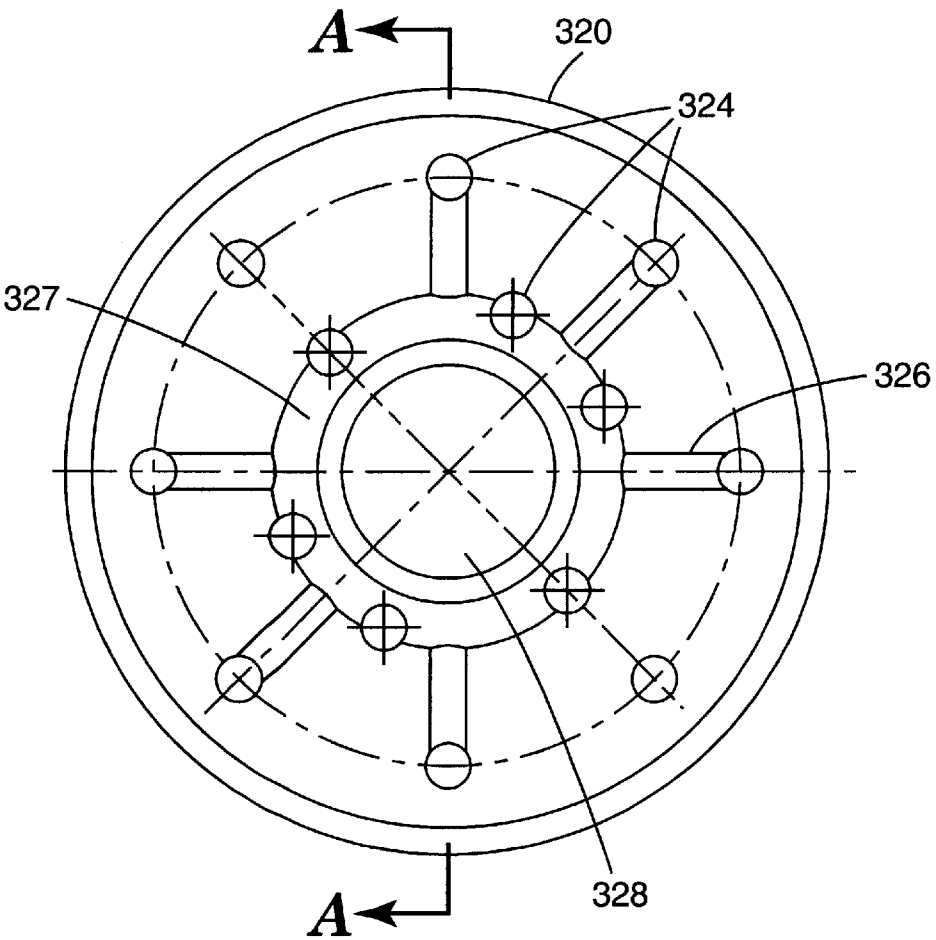
FIG. 10 is plan view of a diaphragm backing ring in accordance with the present invention shown from the side opposite the diaphragm.

Positioned within the backing ring bore 217 is a backing ring 320 that includes an opening 328 through which the stem 308 passes, and a mating surface 322 contoured to correspond to the stem-side configuration of the diaphragm's central region 306, hereinafter the drive surface 307. Referring now also to FIGS. 10 and 11, the backing ring 320 includes a series of through holes 324 symmetrically located in two concentric ring patterns around the opening 328.

Also preferably included in the backing ring 320 is a bore 327 with a radiused inside corner 329, formed in a base 323 on the piston-side of the backing ring 320. A spring 310 encircling the stem 308 is interposed between bore 327 and a nut 312 threaded onto the stem 308. The spring 310 provides a spring force to aid in the return movement of the diaphragm 300 away from the first chamber 150.

Connecting the bore 327 to the holes 324 are a plurality of grooves 326 that facilitate the passage of drive fluid 205 from the diaphragm portion 216 through the backing ring holes 324 and into contact with the drive surface 307 of the diaphragm's central drive region 306. The pressure of the drive fluid 205 causes the diaphragm 300 to move away firm the piston 230, toward the first chamber 150, deflecting at the flexing region 304.

Within the first chamber 150, a corresponding bore 156 is formed opposite the second chamber bore 217. Located within the first chamber bore 156 is a paint ring 160 having an opening 161 adjacent the paint passage 154, and a diaphragm mating surface 162 contoured to correspond to the configuration of the diaphragm flexible region 304 when the diaphragm 300 moves toward the paint passage 154. A paint chamber 170 located adjacent the paint passage 154 is defined by the diaphragm mating surface 162 of the paint ring 160 and the pumping surface 314 of the diaphragm 300. The paint chamber 170 includes a confined perimeter region 171 located at the perimeter of the paint chamber 170 where the diaphragm flexible region 304 contacts the paint ring 160.

As stated above, the reciprocating motion of the piston 230 causes a corresponding reciprocating motion of the diaphragm 300. As the piston 230 moves away from the diaphragm 300, the diaphragm is drawn towards the backing ring 320 with the help of the spring force caused by spring 310, and paint is drawn in to the first chamber 150 through the paint inlet 110. As shown in FIGS. 2 and 3, the check valve 155 that is positioned within the paint passage 154 allows paint inflow into the paint chamber 170. When the piston 230 moves toward the diaphragm 300, the increase in pressure due to the inflow of drive fluid 205 causes the diaphragm 300 to move away from the backing ring 320, pushing the paint located within the paint chamber 170 out of the chamber 170. The check valve 155 closes against the pressure of the outflowing paint causing the paint to divert through the paint outlet 112.

The efficiency of the pump 100, therefore, depends in a large part on the diaphragm's ability to move the paint out of the paint chamber 170 relative to its drive fluid driven motion. A shortcoming of prior art diaphragm pumps is the formation of pockets of stagnant paint within the paint chamber 170 in the perimeter region 171. Not only does the prior art pump's inability to push this volume of paint out of the pump with each stroke of the piston result in inefficiency, but it also results in problems related to the stagnant paint within the pump. The stagnant areas lodged between the diaphragm 300 and the paint chamber housing 152 are difficult to adequately clear out during cleaning of the pump 100. However, if these stagnant areas are not adequately flushed, the paint will eventually dry and the pump 100 will ultimately fail to function.

The diaphragm pump 100 of the present invention overcomes these shortcomings through innovative modifications to the backing ring 320 that result in expulsion of substantially all of the paint within the paint chamber 170, thereby increasing the efficiency of the pump 100. Between the drive surface 307 and the mating surface 322 of the backing ring 320, a drive fluid chamber 350 is defined that changes in shape and volume as the diaphragm 300 reciprocates. The inflow of drive fluid 205 into this chamber 350 through the series of holes 324 and the distribution of the drive fluid 205 within the chamber 350 are both based on the mating surface 322 profile, which is thus a critical factor in the movement of the diaphragm 300 and the expulsion of paint from the paint chamber 170. In addition, the mating surface 322 profile has a key role in the expulsion of drive fluid 205 from the chamber 350 when the diaphragm 300 moves toward the piston 230, thereby allowing for more efficient use of the inflowing drive fluid 205 on the next stroke of the piston 230.

As shown in FIG. 11, the diaphragm mating surface 322 of the backing ring 320 is shaped by a depression 332 formed on the drive side 325 of the ringy 320. The depression 332 includes a shoulder 337 formed at an angle 341 relative to the base 323 of preferably about 3.64 degrees, and a wall 336 sloping down from the shoulder 337 to a floor 334. The angle 340 of the wall 336 is preferably about 45 degrees. The overall diameter 330 of the ring 320 is preferably about 1.334 inches and the overall depth 331 of the ring 320 is preferably about 0.380 inches, being sized to mate with the bore 217 and the diaphragm 300. The preferable radius 343 of the depression 332 without the shoulder 337, as measured from a longitudinal centerline 321, is about 0.471 inches and the depth 335 of the depression 332 is preferably about 0.196 inches. A smooth transition from the angled shoulder 337 to the angled wall 336 is preferably achieved by a radiused corer 339 having a radius of about 0.138 inches. A smooth transition from the angled wall 336 to the floor 334 is also preferably provided by a radiused comtier 338 having a radius of about 0.136 inches.

The opening 328 passes through the floor 334 of the depression 332, and the series of holes 324, preferably each of about 0.079 inches in diameter, intersect the mating surface 322 of the depression 332 near the floor/wall transition and near the wall/shoulder transition at radiuses of about 0.295 and 0.512 inches from axis 321. When the drive fluid 205 is driven by the piston 230 stroke toward the diaphragm 300, the drive fluid encounters the backing ring bore 327 and is distributed out of the bore 327 through grooves 326 to the outer ring of holes 324, the inner ring of holes 324 and opening 328. The drive fluid 205 enters the drive fluid chamber 350 at various points around the mating surface 322, acting directly on the drive surface 307 of the diaphragm 300 and distributing throughout the drive fluid chamber 350 to act on the drive surface 307 at other locations. The pressure of the inflowing drive fluid 205 causes the diaphragm 300 to move toward the first chamber 150, thereby pushing the paint out of the adjacent paint chamber 170.

The backing ring 320 is preferably formed from Delrin™. The backing ring 320 may be molded to exact specifications. However, other suitable materials and fabrication methods are also contemplated and within the scope of the present invention.

Figure 12:
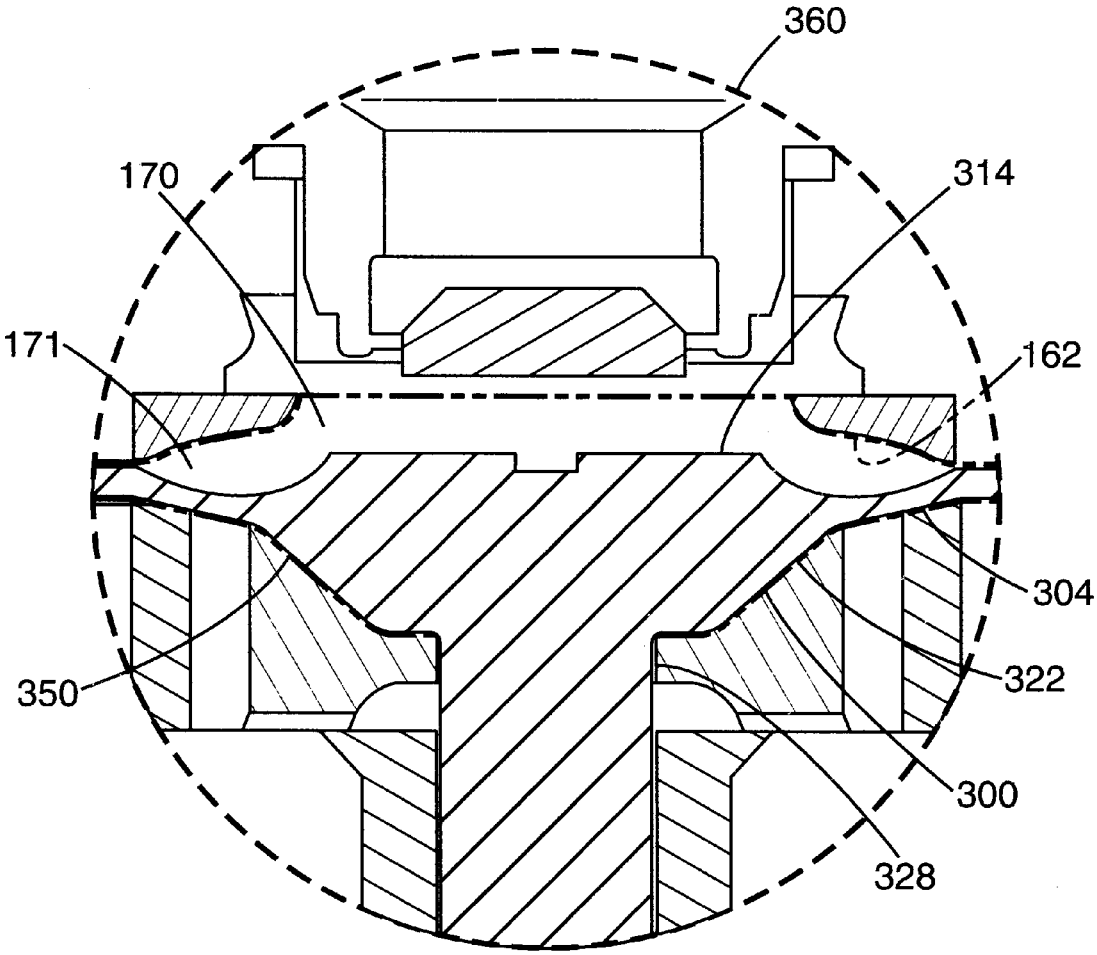
FIG. 12 is a simplified cross-sectional representation of the diaphragm of FIG. 9 shown in its bottom-dead-center position.

In FIGS. 12–16, the movement of the diaphragm 300, from a first limit in a position closest to the piston 230, or bottom-dead-center position (in FIG. 12) to a second limit at a position farthest from the piston 230, or top-dead-center position (in FIG. 16), is illustrated as a series of time steps, Steps 360, 362, 364, 366 and 368, respectively. In FIG. 12, on the outward stroke of the piston 230. the diaphragm 300 is drawn against the mating surface 322 of the backing ring 320 (Step 360), thereby minimizing the volume of the drive fluid chamber 350 and forcing the drive fluid 205 back into the diaphragm portion 216 of the cylinder 214. At this time, paint is drawn into the paint chamber 170 from the paint source.

Figure 13:
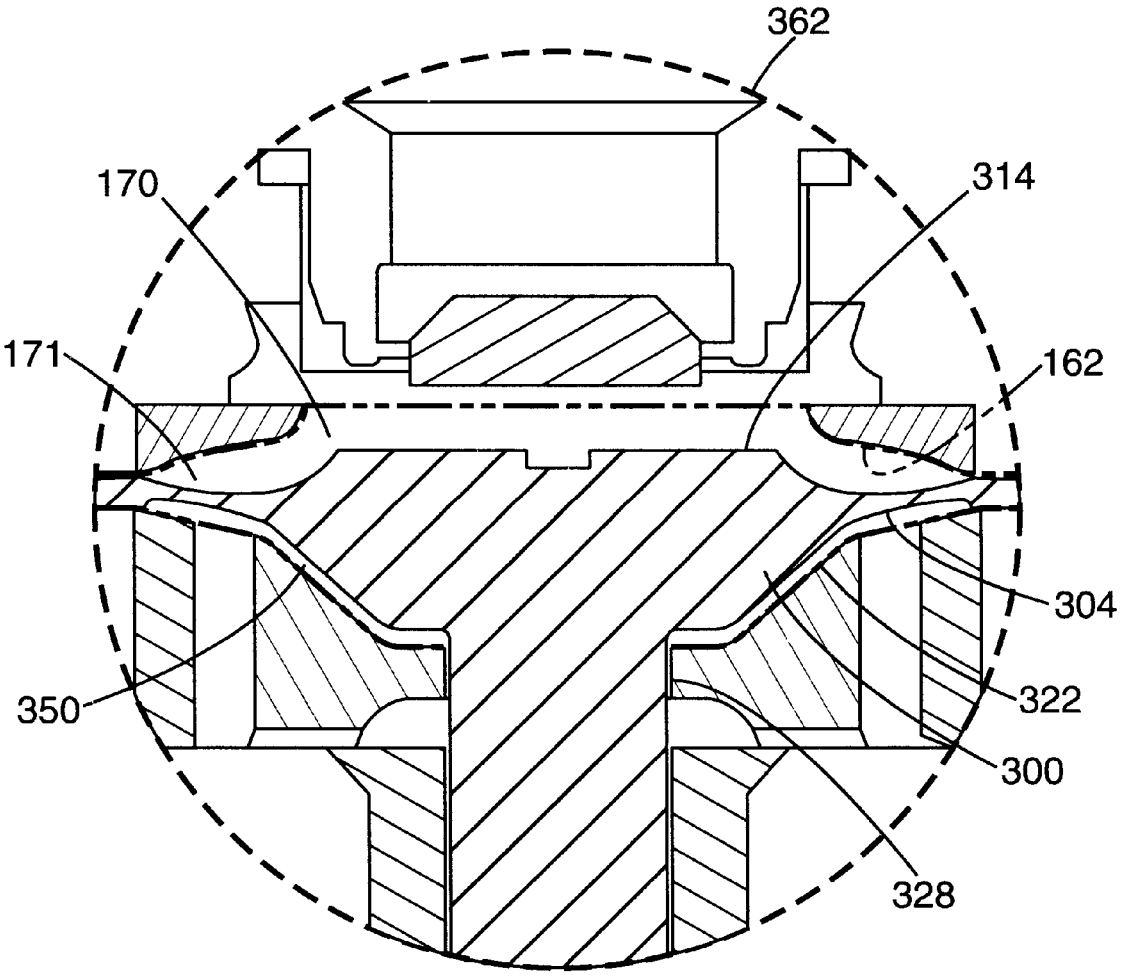
FIG. 13 is a view similar to that of FIG. 12 except shown at a first time step as the diaphragm moves from bottom-dead-center to top-dead-center position.

In FIG. 13, as the direction of the piston stroke changes and the drive fluid 205 inflows from the diaphragm portion 216, the diaphragm 300 starts to move away from the piston 230 and toward the first chamber 150 (Step 362), creating a partial volume in drive fluid chamber 350. The pumping surface 314 of the diaphragm 300 pushes on the volume of paint within the paint chamber 170 forcing it out through the paint outlet 112.

Figure 14:
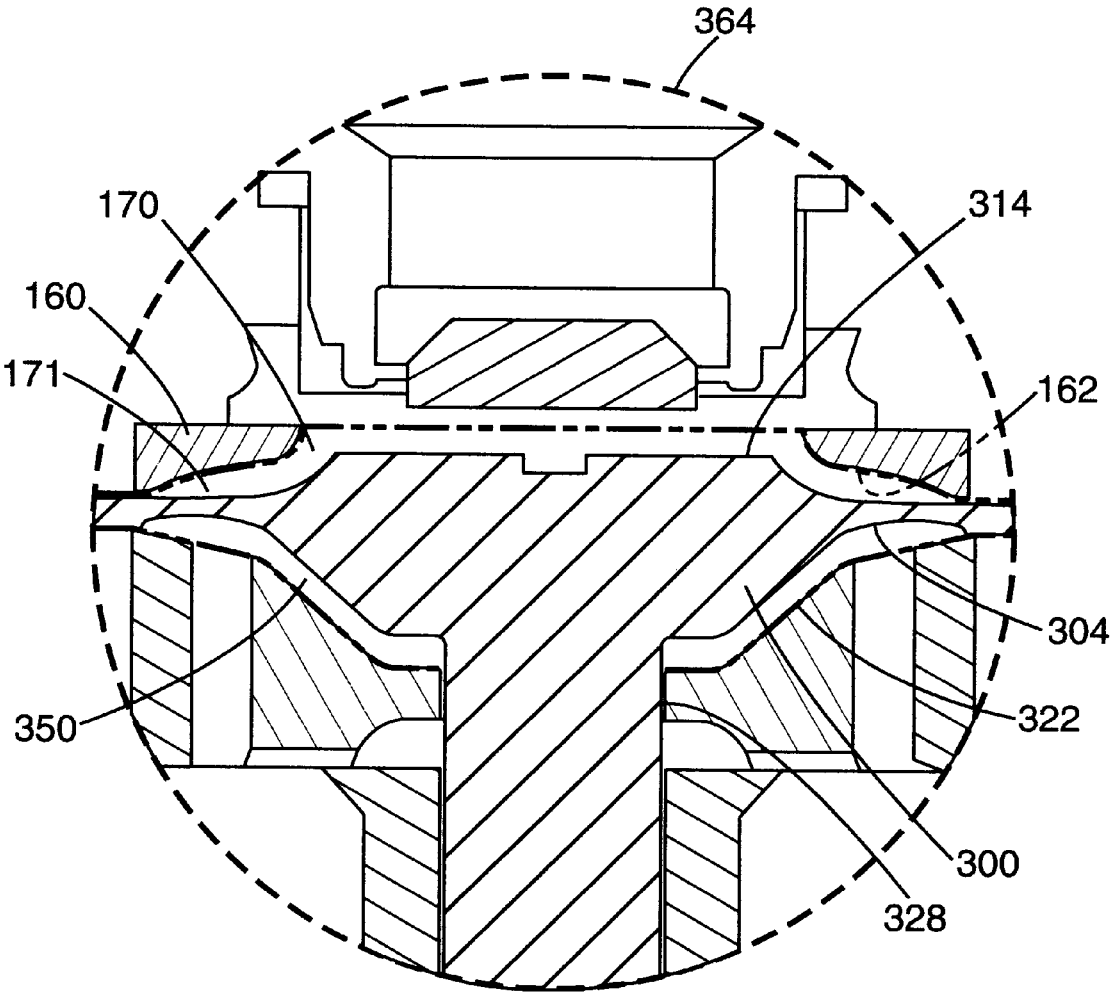
FIG. 14 is a view similar to that of FIG. 12 except shown at a second time step as the diaphragm moves from bottom-dead-center to top-dead-center position.

In FIG. 14, as the drive fluid 205 continues to inflow into the drive fluid chamber 350, the flexible region 304 of the diaphragm 300 starts to deflect toward the mating surface 162 of the paint ring 160 (shown in phantom) (Step 364) causing the paint located in the perimeter region 171 of the paint chamber 170 to move toward the center of the pumping surface 314.

Figure 15:
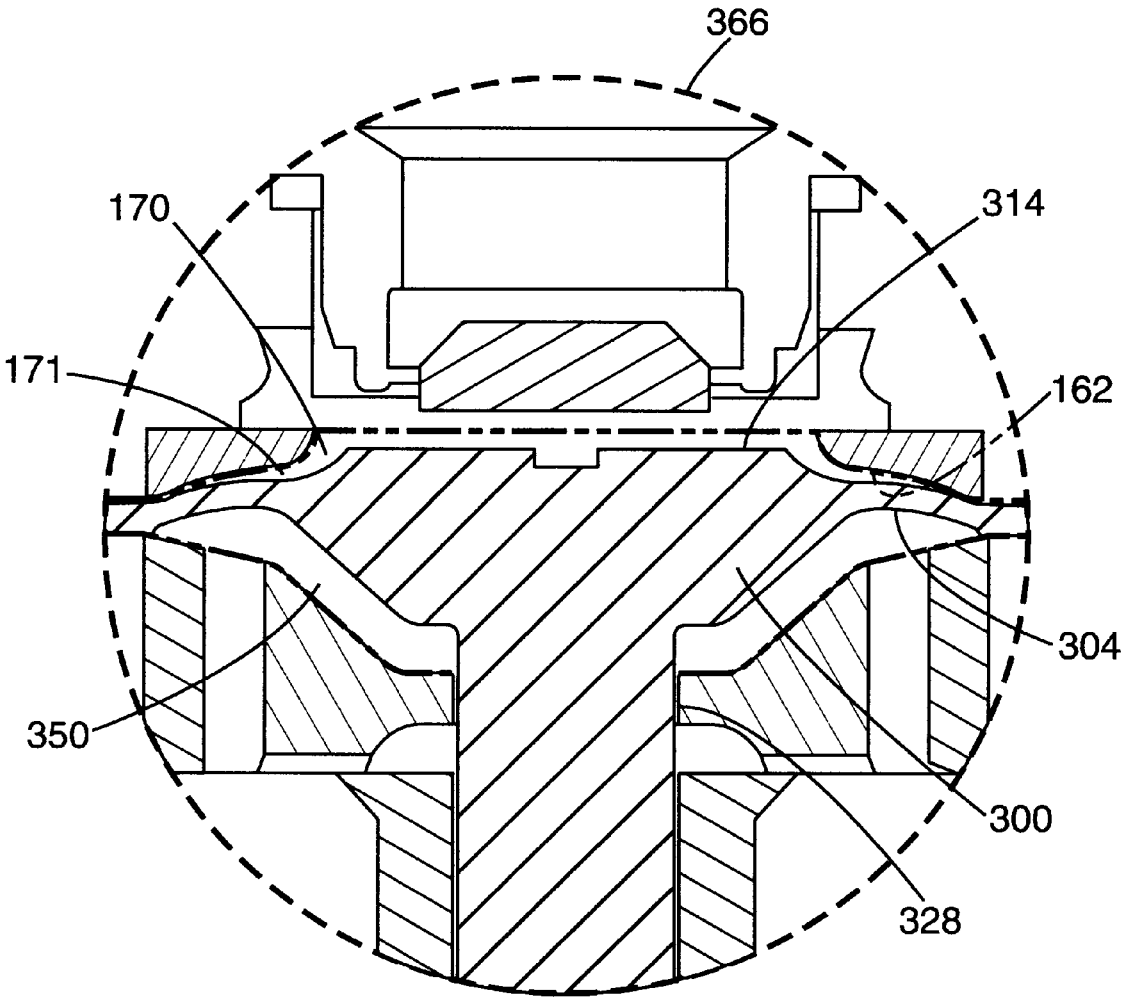
FIG. 15 is a view similar to that of FIG. 12 except shown at a third time step as the diaphragm moves from bottom-dead-center to top-dead-center position.

In FIG. 15, with the continuing inflow of drive fluid 205 into the drive fluid chamber 350, the flexible region 304 deflects enough to start conforming to the contour of the paint ring mating surface 162 from the perimeter inward toward the center (Step 366). The paint located in the perimeter region 171 of the paint chamber 170 is forced toward the center to be expelled out of the chamber 170 along with the central volume of paint within the chamber 170.

Figure 16:
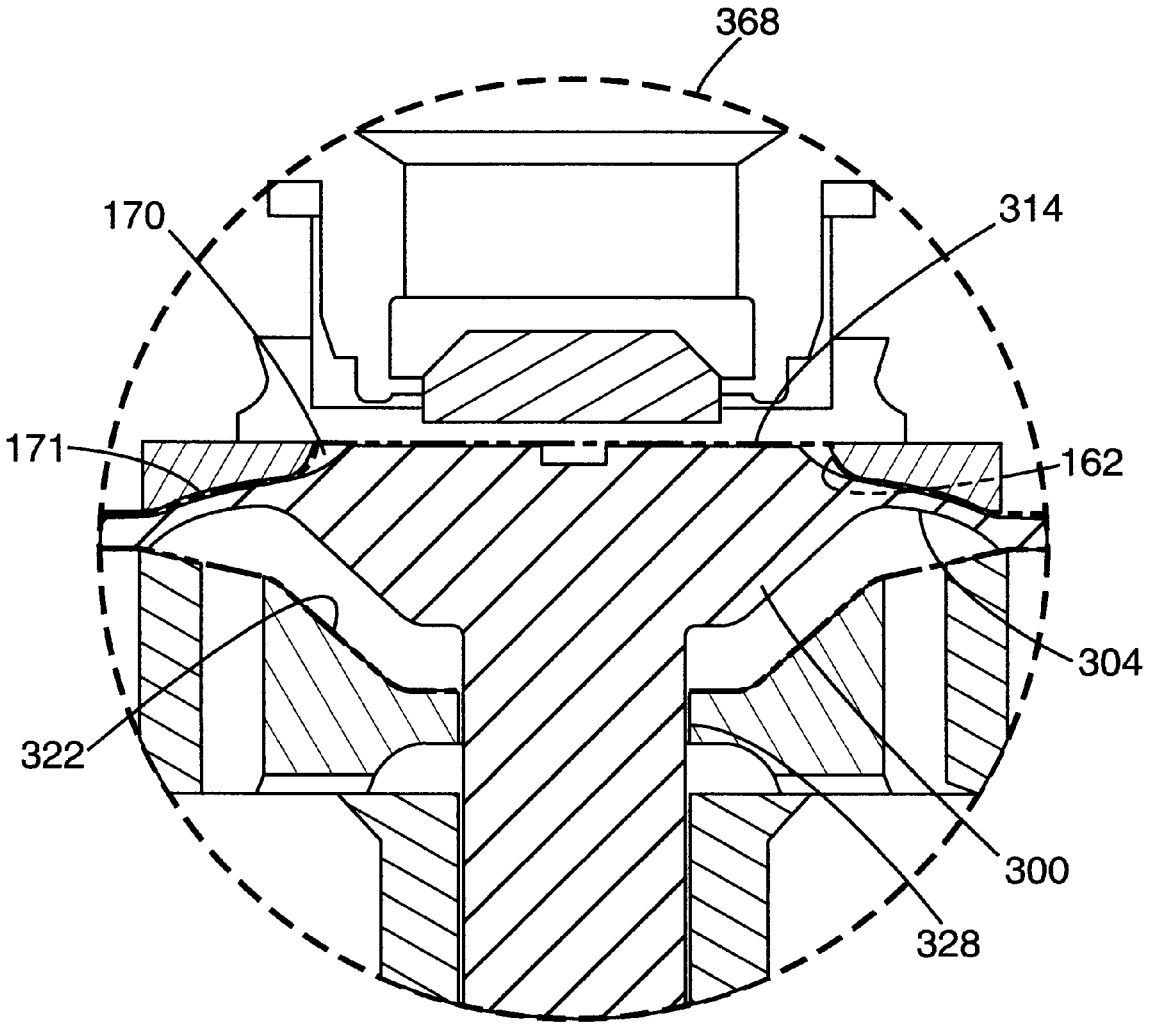
FIG. 16 is a simplified cross-sectional representation of the diaphragm of FIG. 9 shown in top-dead-center position.

In FIG. 16, the diaphragm 300 has reached its top-dead-center position (Step 368). The volume of the drive fluid chamber 350 is at maximum, and the volume of the paint chamber 170 is at its minimum. The flexible region 304 of the diaphragm 300 has deflected to substantially conform to the contour of the paint ring mating surface 162, thereby expelling substantially all of the paint within the perimeter region 171 of the paint chamber 170. With substantially all of this paint expelled, no regions of stagnant paint remain within the perimeter region 171 of the paint chamber 170, thereby fully utilizing the stroke of the pump 100 to pump paint to the paint spray gun to be applied to a surface and eliminating the shortcomings of the prior art pump design. Although only one half of the reciprocating cycle of the diaphragm 300 has been illustrated, it is to be understood that diaphragm 300 returns to the position shown in FIG. 12 after reaching the position shown in FIG. 16, during which time a new volume of paint enters chamber 170.

Through the innovative redesign of the drive fluid inlet, the present invention pump eliminates pump problems due to air in the drive fluid system, decreases the number of parts needed to provide the same drive fluid function, and decreases the amount of machining involved in producing the drive fluid system. as well as errors arising from such machining. Through the innovative improvements in the diaphragm backing ring design, the present invention pump is able to fully utilize the drive fluid provided to efficiently expel the paint from the pump.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. A diaphragm pump apparatus comprising:

a. a first chamber that accommodates and dispenses a fluid to be pumped;

b. a second chamber that accommodates a drive fluid;

c. a diaphragm that separates the first chamber from the second chamber and has a first chamber side and a second chamber side, the diaphragm including an outer perimeter mounting region, a thin inner perimeter flexible region, and a curvedly contoured central drive region having a stem on the second chamber side and a central pumping surface on the first chamber side, the diaphragm movable from a first limit farthest away from the first chamber to a second limit closest to the first chamber;

d. a piston located at least partially within the second chamber driven by a motor mounted eccentric that causes reciprocating movement of the piston, the piston movement resulting in corresponding drive fluid movement within the second chamber; and e. a backing ring mounted within the second chamber adjacent to the diaphragm defining a central opening through which the stem of central drive region of the diaphragm passes, the backing ring including:

i) a plurality of holes passing through the backing ring, the plurality of holes configured to distribute the drive fluid across the flexible region and the central drive region of the diaphragm after the drive fluid is driven by the drive fluid movement within the second chamber through the plurality of holes, at least some of the plurality of holes positioned within the backing ring opposite the flexible region of the diaphragm; and ii) a diaphragm mating surface curvedly contoured to mate with the second chamber side of the diaphragm, such that pressure formed by the drive fluid passing through the plurality or holes into a drive fluid volume located between the diaphragm mating surface of the backing ring and the second chamber side of the diaphragm drives the diaphragm from first the limit toward the first chamber while flexing the flexible region of the diaphragm toward the first chamber from the outer perimeter inward toward the central pumping surface in a rolling manner, the diaphragm moving substantially all of the fluid to be pumped adjacent the diaphragm within the first chamber radially inward toward the central pumping surface and then out of the first chamber when the diaphragm reaches the second limit.

2. The diaphragm pump apparatus of claim 1, wherein the diaphragm mating surface of the backing ring substantially conforms to the second chamber side of the diaphragm when the diaphragm is at the first limit.

3. The diaphragm pump apparatus of claim 2, wherein substantially all of the drive fluid located in the drive fluid volume during reciprocating movement of the diaphragm from the first limit to the second limit is removed from the drive fluid volume when the diaphragm reaches the first limit.

4. The diaphragm pump apparatus of claim 3, wherein the second chamber comprises a reservoir and a piston portion in fluid communication between the reservoir and the diaphragm.

5. The diaphragm pump apparatus of claim 4, further comprising a drive fluid outlet having a valve, the outlet in fluid communication between the piston portion and the reservoir, wherein drive fluid removed from the drive fluid volume passes back into the reservoir through the drive fluid outlet.

6. The diaphragm pump apparatus of claim 1, wherein the first chamber comprises a first chamber ring mounted within the first chamber adjacent the diaphragm, the first chamber ring inicluding a diaphragm mating surface contoured to mate with the first chamber side of the diaphragm to facilitate the movement of the fluid to be pumped toward the central pumping surface.

7. The diaphragm pump apparatus of claim 6, wherein the flexible region of the diaphragm conforms to the first chamber ring diaphragm mating surface at the second limit of the diaphragm.

8. The diaphragm pump apparatus of claim 1, wherein the diaphragm mating surface comprises an annular top surface formed around a perimeter of the backing ring and a depression formed within a central portion of the backing ring about a longitudinal axis passing through the center of the backing ring, the depression including a floor adjacent the central opening of the backing ring, and an angled wall formed between the depression floor and the top surface, with the plurality of holes positioned opposite the flexible region of the diaphragm intersecting the annular top surface of the backing ring.

9. The diaphragm pump apparatus of claim 8, wherein the top surface is formed at an angle relative to a plane that is perpendicular to the longitudinal axis of the backing ring.

10. The diaphragm pump apparatus of claim 9, wherein the angle of the top surface is about 3.6 degrees.

11. The diaphragm pump apparatus of claim 8, wherein the angle of the depression wall is about 45 degrees relative to the longitudinal axis of the backing ring.

12. A diaphragm pump apparatus comprising:

a. a first chamber for accommodating and dispensing a fluid to be pumped;

b. a second chamber for accommodating a drive fluid, the second chamber in fluid communication with a drive fluid reservoir substantially filled with a quantity of drive fluid;

c. a diaphragm that separates the first chamber from the second chamber and has a first chamber side and a second chamber side, the diaphragm including an outer perimeter mounting region, a thin inner perimeter flexible region, and a curvedly contoured central drive region having a stem on the second chamber side and a central pumping surface on the first chamber side, the diaphragm movable from a first limit farthest away from the first chamber to a second limit closest to the first chamber;

d. a piston having first and second ends with the first end located at least partially within a piston cylinder having a wall and a passage included as part of the second chamber, the piston being driven at the second end by a motor mounted eccentric causing reciprocating movement of the piston within the piston cylinder, the piston movement resulting in corresponding drive fluid movement within the second chamber flexing the diaphragm to provide a pumping action within the first chamber for dispensing the fluid to be pumped;

e. a drive fluid inlet for supplying drive fluid to the second chamber from the drive fluid reservoir, the drive fluid inlet including:

i) a drive fluid supply passage formed axially within the piston having a first end and a second end, the first end of the supply passage open to the second chamber at the first end of the piston; and ii) an input port formed within the piston transverse to the supply passage, an inner end of the input port intersecting the supply passage near the second end of the supply passage, and an outer end of the input port open to an exterior of the piston, the input port positioned within an interior of the drive fluid reservoir with the outer end of the input port submerged in the drive fluid at a predetermined position of the piston within the piston cylinder of the second chamber, such that the outer end of the input port is closed by the piston cylinder to the drive fluid in the drive fluid reservoir during a portion of the reciprocating movemnent of the piston, and at least a portion of the outer end of the input port is open to and submerged in the drive fluid in the drive fluid reservoir at another portion of the reciprocating movement of the piston resulting in an inflow of drive fluid through the input port into the supply passage and second chamber; and f. a backing ring mounted within the second chamber adjacent to the diaphragm defining a central opening through which the stem of central drive region of the diaphragm passes, the backing ring comprising:

i) a plurality of holes configured to distribute the drive fluid across the flexible region and the central drive region of the diaphragm after the drive fluid is driven by the drive fluid movement within the second chamber through the plurality of holes, at least some of the plurality of holes positioned within the backing ring opposite the flexible region of the diaphragm; and ii) a diaphragm mating surface curvedly contoured to mate with the second chamber side of the diaphragm, such that pressure formed by the drive fluid passing through the plurality of holes into a drive fluid volume defined between the diaphragm mating surface of the backing ring and the second chamber side of the diaphragm drives the diaphragm from the first limit toward the first chamber while flexing the flexible region of the diaphragm toward the first chamber from the outer perimeter inward toward the central pumping surface in a rolling manner, the diaphragm moving substantially all of the fluid to be pumped adjacent the diaphragm within the first chamber inward toward the central pumping surface and then out of the first chamber when the diaphragm reaches the second limit.

13. A method of pumping a fluid using a diaphragm pump apparatus comprising a first chamber that accommodates and dispenses a fluid to be pumped, a second chamber that accommodates a drive fluid, and a diaphragm that separates the first chamber from the second chamber, the method comprising the steps of:

a. providing a drive fluid within the second chamber from a drive fluid reservoir;

b. providing a fluid to be pumped within the first chamber;

c. flexing a flexible region of the diaphragm from an outer perimeter inward in a rolling manner so that the flexible region of the diaphragm conforms to a contoured portion of the first chamber to push substantially all the fluid to be pumped adjacent to a first chamber side of the diaphragm radially inward and then out of the first chamber, flexing of the flexible region occurring by the delivery of the drive fluid to the second chamber, without air introduction into the second chamber, via a drive fluid supply passage formed within a piston and open to the second chamber, the piston having an input port fluidly coupled to the supply passage and positioned within the interior of the drive fluid reservoir so as to submerge the input portion within the drive fluid in the drive fluid reservoir at a predetermined position of the piston within the second chamber, the piston closing the input port to the drive fluid in the drive fluid reservoir during a portion of a reciprocating movement of the piston and submerging the input port into the drive fluid in the drive fluid reservoir at another portion of the reciprocating movement of the piston resulting in controlled inflow of drive fluid through the input port into the supply passage and second chamber, with substantial elimination of air introduction into the second chamber occurring by completely submerging the input port in the drive fluid within the drive fluid reservoir when the input port is open to the drive fluid reservoir at all orientations of the diaphragm pump apparatus relative to the ground.

14. The method of clain 13, wherein step c further comprises regulating the pressure within the second chamber through a valve in fluid communication with the second chamber.

* * * * *